US008299693B2

(12) United States Patent
Chen

(10) Patent No.: US 8,299,693 B2
(45) Date of Patent: Oct. 30, 2012

(54) LAMP DEVICE OF HIGH HEAT DISSIPATION EFFICIENCY

(76) Inventor: Shyh-Ming Chen, Taipei Hsien (TW)

( * ) Notice: Subject to any disclaimer, the term of this patent is extended or adjusted under 35 U.S.C. 154(b) by 125 days.

(21) Appl. No.: 12/967,082

(22) Filed: Dec. 14, 2010

(65) Prior Publication Data

US 2011/0140588 A1 Jun. 16, 2011

(30) Foreign Application Priority Data

Dec. 11, 2009 (TW) ..... 98142414 A

(51) Int. Cl.
*H01J 1/02* (2006.01)
*F21V 29/00* (2006.01)

(52) U.S. Cl. ..... 313/46; 362/294

(58) Field of Classification Search ..... None
See application file for complete search history.

(56) References Cited

U.S. PATENT DOCUMENTS 6,631,999 B1 * 10/2003 Chang ..... 362/96
7,524,089 B2 * 4/2009 Park ..... 362/294
7,837,363 B2 * 11/2010 Liu ..... 362/373
8,057,071 B2 * 11/2011 He et al. ..... 362/294
8,057,075 B2 * 11/2011 Horng et al. ..... 362/373
8,115,395 B2 * 2/2012 Horng et al. ..... 315/117
2006/0193139 A1 * 8/2006 Sun et al. ..... 362/373
2009/0160344 A1 * 6/2009 Hsu et al. ..... 315/117

* cited by examiner

*Primary Examiner* — Anh Mai
*Assistant Examiner* — Britt D Hanley

(57) ABSTRACT

A lamp device comprises a lamp seat, having a body; a heat installed at an upper end of the body for electrically connecting to an external power source; an electric joint extending from the head; and a connecting shaft extending downwards; and a heat dissipation assembly including: a heat dissipating mask having an axial hole; the connecting shaft passing through the axial hole so that the heat dissipating mask is connected to the body; and the heat dissipating mask is rotatable; a conductive unit installed at an upper side of the heat dissipating mask; the conductive unit being electrically connected to the electric joint even the heat dissipating mask rotates with respect to the body; and a lamp set driven electrically and installed at a lower side of the heat dissipating mask; and the lamp set being retained to the conductive unit through the heat dissipating mask.

14 Claims, 6 Drawing Sheets

LAMP DEVICE OF HIGH HEAT DISSIPATION EFFICIENCY

FIELD OF THE INVENTION

The present invention relates to a lamp device, and in particular to a lamp device with high heat dissipation efficiency.

BACKGROUND OF THE INVENTION

LED lamps have long lifetime and thus they are gradually used to replace the conventional lamps for power saving.

LEDs are designed as a lamp set, that is, a plurality of LEDs are assembled as one set. However, this induces a problem of heat dissipation. With reference to FIG. 1, a plurality of LED lamp devices 10 are illustrated. As illustrated in the drawing, a lower end of the lamp head 12 is combined with a heat dissipation mask 14 which is formed by a plurality of heat dissipating fins. A lower end or an internal center of the heat dissipation mask 14 is installed with a plurality of LEDs (not shown). When the LEDs light up, heat generated will disperse from the heat dissipation mask 14 so as to prolong the lifetime of the LEDs.

However, the LEDs generate heat continuously to be over the burden of the heat dissipation mask 14 so that the number of LEDs used must be limited or the heat dissipation mask 14 is enlarged. In fact, all these ways are not suitable. Finally, the lamp device 10 will destroy.

SUMMARY OF THE INVENTION

The object of the present invention is to provide a lamp device which can dissipate heat efficiently and thus to prevent heat accumulation so as to prolong the lifetime of the lamp device. Therefore, it achieves the object of environment protection.

To achieve above object, the present invention provides a lamp device, comprising: a lamp seat, having a body; a heat installed at an upper end of the body for electrically connecting to an external power source; an electric joint extending downwards from the head; and a connecting shaft extending downwards; and a heat dissipation assembly including: a heat dissipating mask having an axial hole; the connecting shaft passing through the axial hole so that the heat dissipating mask is connected to the body; and the heat dissipating mask is rotatable with respect to the body; a conductive unit installed at an upper side of the heat dissipating mask; the conductive unit being electrically connected to the electric joint even the heat dissipating mask rotates with respect to the body; and a lamp set driven electrically and installed at a lower side of the heat dissipating mask; the lamp set being retained to the conductive unit through the heat dissipating mask.

Further, the present invention provides a lamp device comprising: a seat electrically connected to an external power source; and a heat dissipation assembly connected to the seat and being rotatable with respect to the seat; one end of the heat dissipation assembly having light emitting elements electrically connected to the seat. The seat further has a body; a head installed at an upper end of the body for electrically connecting an external power source. The seat further includes a body; a head installed at an upper end of the body for electrically connecting an external power source; an electric joint downwards extending from the head; the heat dissipation assembly further including: a head heat dissipating mask being connected to the body; and the heat dissipating mask being rotatable with respect to the body; a conductive unit installed in the heat dissipating mask; the conductive unit being electrically connected to the electric joint even the heat dissipating mask rotates with respect to the body; and a lamp set driven electrically and installed in the heat dissipating mask; the lamp set being retained to the conductive unit through the heat dissipating mask.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

The present invention relates to a lamp device having a seat and a heat dissipation assembly. The seat is electrically connected to an external power source so that the heat dissipation assembly is connected to the seat and is rotatable with respect to the seat. One end of the heat dissipating assembly has a lamp set or light emitting elements which are electrically connected to the seat.

Figure 1:
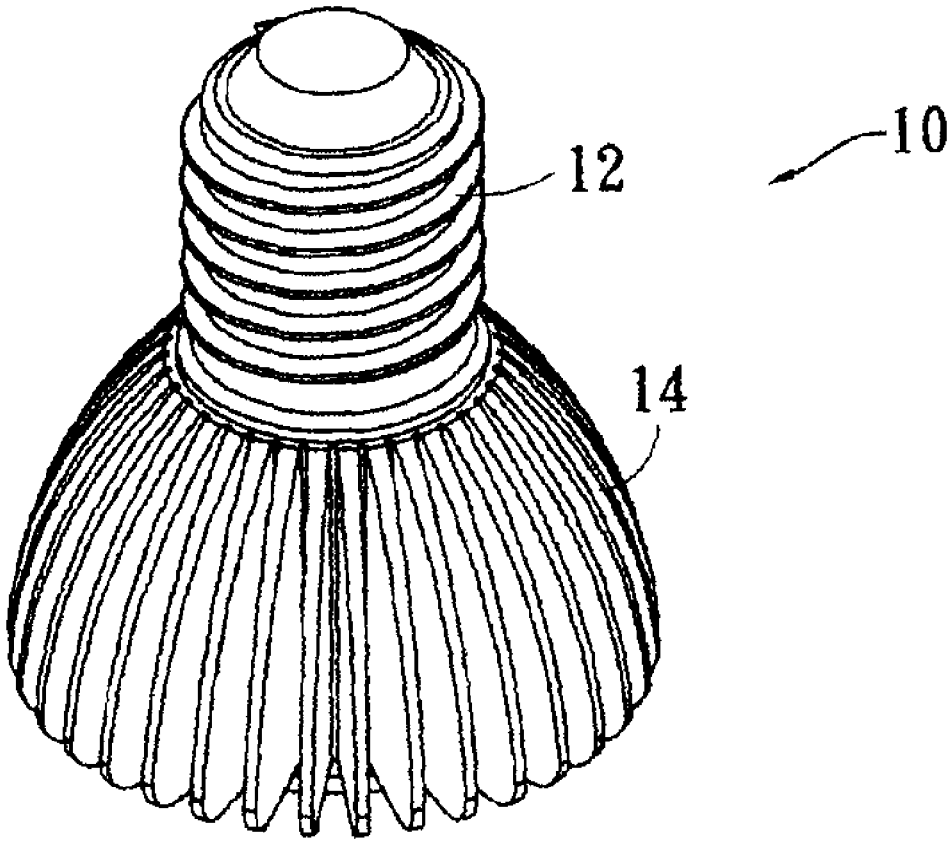
FIG. 1 (Prior Art )
FIG. 1 is a schematic view showing the outlook of the LED lamp device of the prior art.
Figure 2:
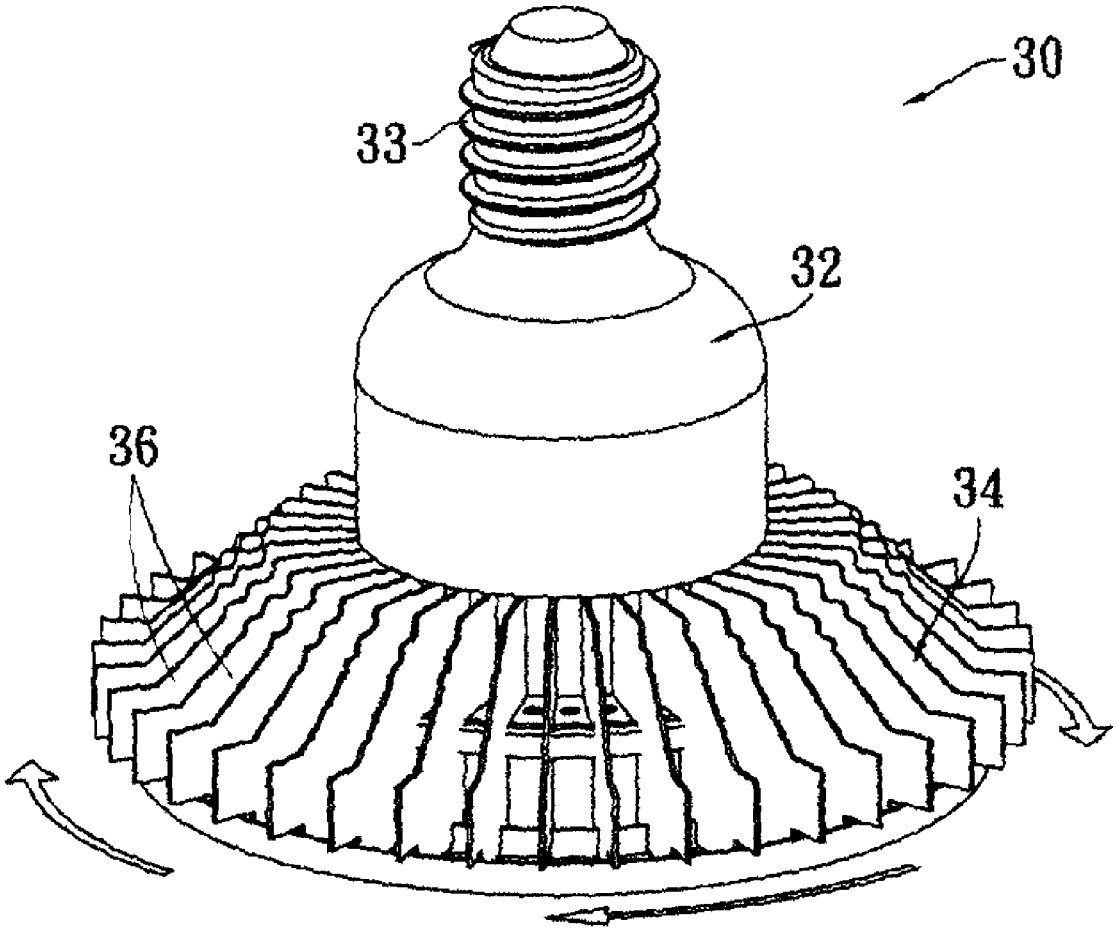
FIG. 2 is a schematic view of the lamp device of the present invention.

With reference to FIG. 2, the lamp device 30 of the present invention is illustrated. The lamp device 30 includes a seat 32 and a heat dissipation assembly 34. The seat 32 has a head 33. The head 33 is not limited to have threads at the outside thereof. Other head with an electric joint or an electric combining end is also suitable in the present invention. The head 33 serves to be connected to other electric power source which may be the lamp base installed on a wall, on the ceiling or a frame. The heat dissipation assembly 34 includes a plurality of heat dissipation fins 36 which are radiatedly distributed for dissipating heat. In the present invention, the heat dissipation assembly 34 is rotatable with respect to the seat 32.

Figure 3:
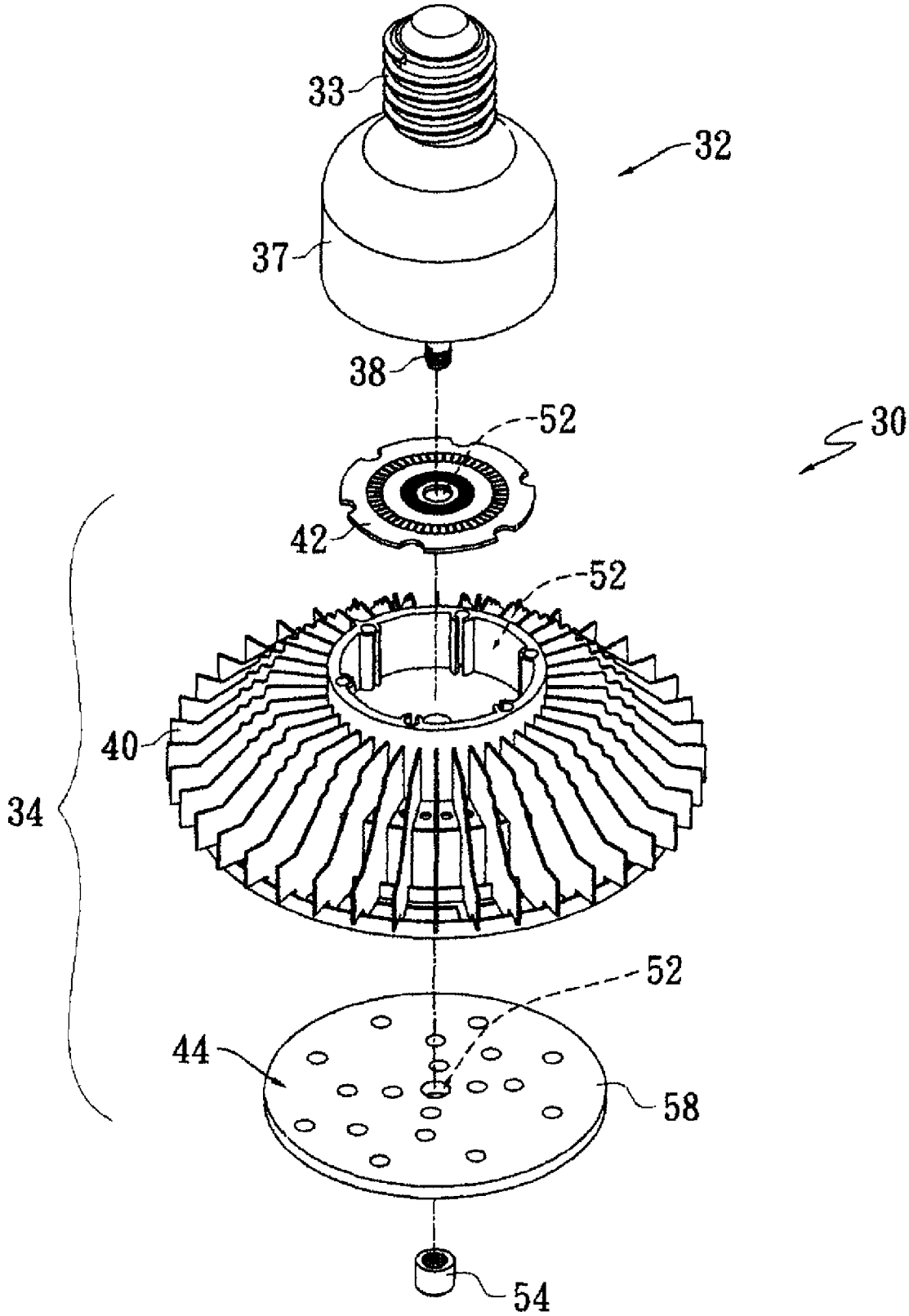
FIG. 3 is an exploded perspective view of the lamp device of the present invention.

With reference to FIG. 3, other than the head 33, the seat 32 further has a body 37 and a connecting shaft 38. The heat dissipation assembly 34 further includes a heat dissipating mask 40, a conductive unit 42 and a lamp set 44.

Figure 4:
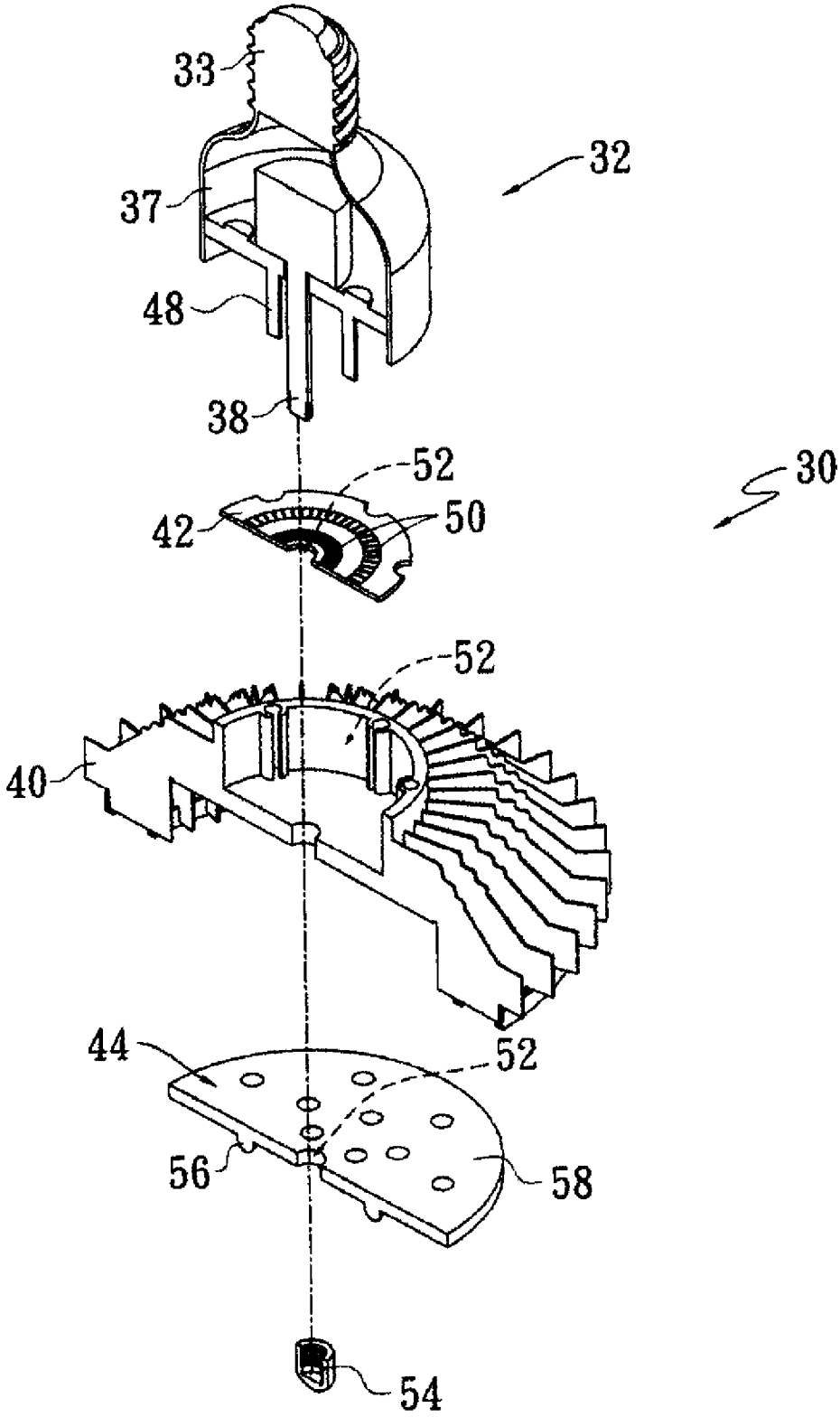
FIG. 4 is a partial exploded perspective view of the lamp device of the present invention.

With reference to FIG. 4 by referring to FIG. 3, in FIG. 4, the head 33 is installed at an upper end of the body 37 for electrically connecting to an electric joint 46. A connecting shaft 38 extends downwards from a center of the body 37. The connecting shaft 38 is a solid shaft.

The electric joint 46 has two electric terminals 38 which are spaced with the connecting shaft 38 with unequal distances. The conductive unit 42 is formed with two circular joints 50. After assembly, lower ends of the two electric terminals 48 contact the two circular joints 50, respectively.

The heat dissipating mask 40, the conductive unit 42 and the lamp set 44 are combined integrally. The heat dissipating mask 40 has an axial hole 52 and a plurality of heat dissipating fins 36. In assembly, the connecting shaft 38 passes through the axial hole 52. A lower end of the connecting shaft 38 is fixed by a retainer, such as a nut 54 or a C buckle, etc. In this embodiment, a nut 54 is used. Thus, the heat dissipating mask 40 is combined to the body 37, and the heat dissipating mask 40 is rotatable with respect to the body 37.

The conductive unit 42 is installed in the heat dissipating mask 40. In the drawing, it is illustrated that the conductive unit 42 is installed at an upper side of the heat dissipating mask 40. Even when the heat dissipating mask 40 rotates with respect to the body 37, the conductive unit 42 is electrically in contact with the electric joint 46.

The lamp set 44 can light up as it is conductive. The lamp set 44 is installed within the heat dissipating mask 40. As illustrated in the drawing, it is installed at a lower side of the heat dissipating mask 40. The lamp set 44 is electrically conductive to the conductive unit 42 through the heat dissipating mask 40. In this embodiment, the lamp set 44 can further include a plurality of LED lamps 56. In the drawing, it is illustrated that it is installed below the circuit board 58.

Therefore, the heat dissipating mask 40 of the heat dissipation assembly 34 is rotatable with respect to the seat 32 so as to increment heat dissipating efficiency. During the rotation process, since the LED lamp 56 always retains to be conductive, it lights up at all time.

Figure 5:
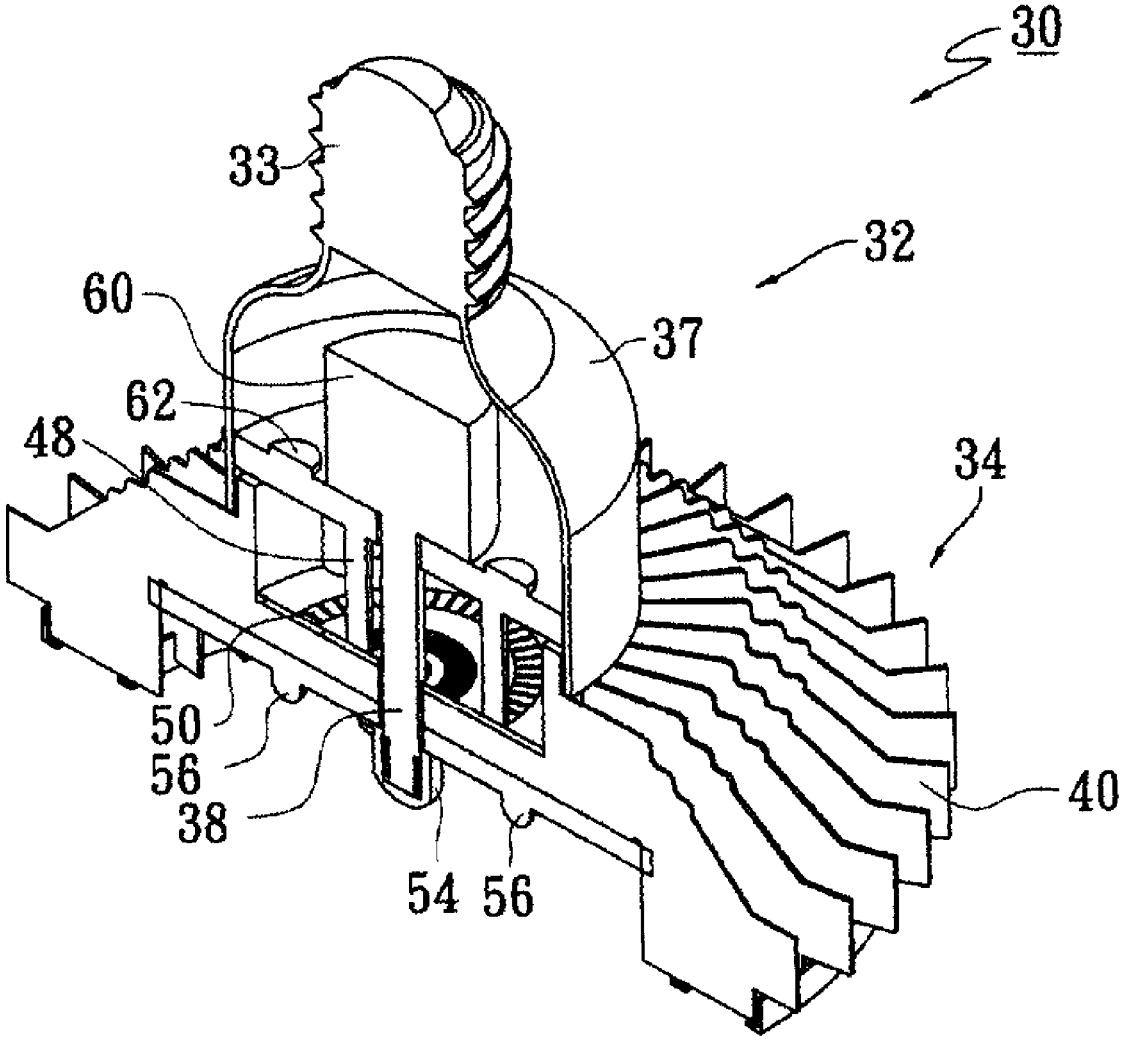
FIG. 5 is a schematic cross sectional view of the lamp device of the present invention.

Referring to FIGS. 4 and 5, to cause the heat dissipation assembly 34 to rotate, it can be driven internally or externally. FIG. 5 shows an example, in that an internal power is used. The connecting shaft 38 passes through the axial hole 52 to be combined to the heat dissipating mask 40. The connecting shaft 38 extends from the motor 60 and rotates by the driving of the motor 60.

Rotation of the heat dissipating mask 40 will drive air to flow so that the heat dissipating mask 40 can contact more cool air at each unit time and thus the heat dissipation is enhanced. Furthermore, the flowing of air will generate heat convection so as to further increase the heat dissipation efficiency of the heat dissipating mask 40.

Besides, as above mentioned lamp device 30, the interior of the body 37 can be further installed with a temperature sensor 62 for detecting the internal temperature of the lamp device 30. When temperature is higher than a predetermined threshold, the motor 60 will be actuated to drive the heat dissipating mask 40 to rotate.

Figure 6:
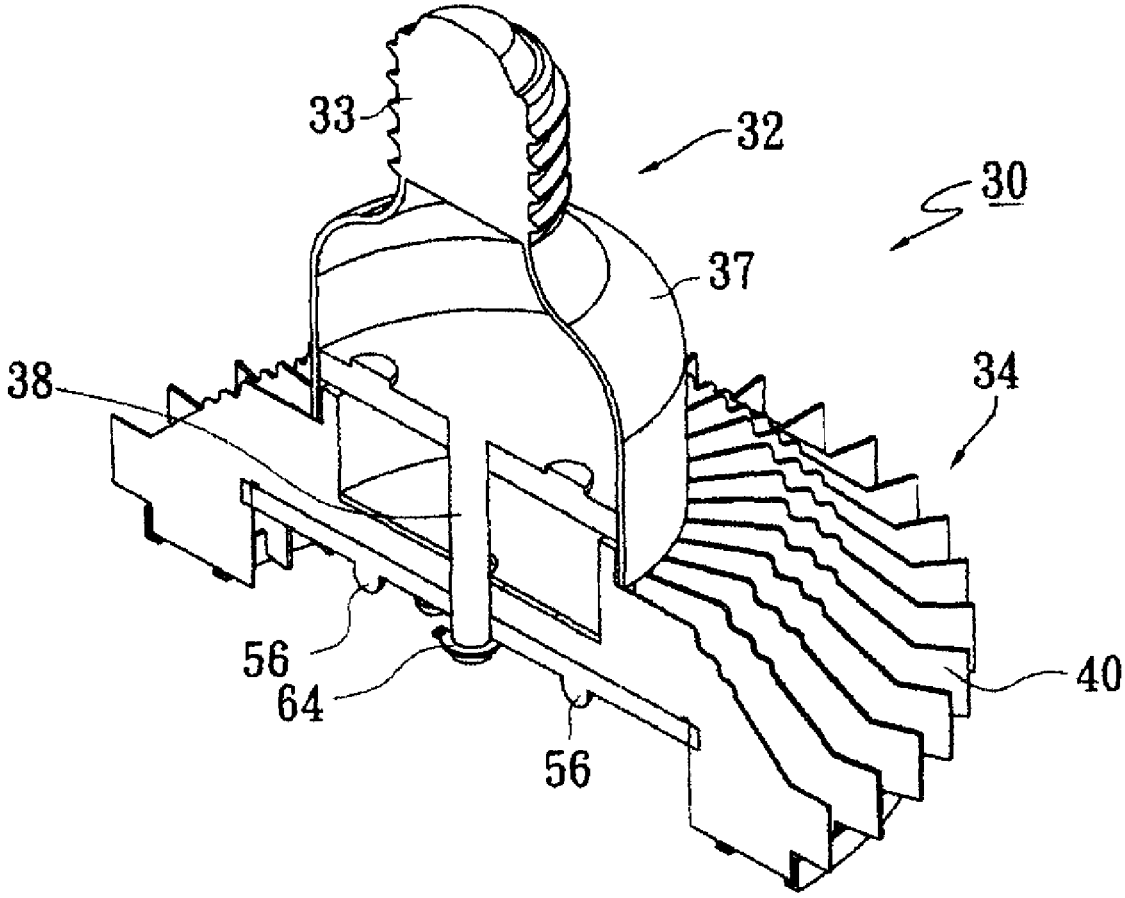
FIG. 6 is a partial schematic view showing the second embodiment of the lamp device of the present invention.

With reference to FIG. 6, the second example of the lamp device 30 of the present invention is illustrated. The seat 32 has no power source. As illustrated in the drawing, the seat 32 has a head 33. The body 37 is connected to the heat dissipating mask 40 through the connecting shaft 38. However, this is not used to confine the scope of the present invention. For example, the lower end of the body 37 of the seat 32 can be embedded to or buckled to the upper end of the heat dissipating mask 40; or the ball bearing or other bearing (not shown) can be installed to the embedding end or the buckling end so that the heat dissipating mask 40 rotates with respect to the body 37. However, above mentioned structures are acceptable in the present invention. A lower end of the connecting shaft 38 is retained to the upper end of the circuit board 58 (as illustrated in FIG. 4) by using a C buckle 64. Therefore, by external wind to blow the heat dissipation fins 36 of the heat dissipating mask 40, as the heat dissipating mask 40 of the heat dissipation assembly 34 rotates with respect to the seat 32, the heat dissipating mask 40 will generate air to flow so as to increase the contact area between the heat dissipating fins 36 and air in each unit time. Furthermore, by heat convection, heat dissipation is enhanced.

Therefore, by the lamp device 30, and by the special designs of the seat 32 and the heat dissipation assembly 34, heat from generation of light can be dissipated quickly so as to prolong the lifetime and safety of the lamp. Moreover, the LED lamp 56 is used as light source so as to achieve the object of power saving and environmental protection.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A lamp device, comprising:

a lamp seat, having a body;

a head installed at an upper end of the body for electrically connecting to an external power source;

an electric joint extending downwards from the head; and a connecting shaft extending downwards; and a heat dissipation assembly including:

a heat dissipating mask having an axial hole; the connecting shaft passing through the axial hole so that the heat dissipating mask is connected to the body; and the heat dissipating mask is rotatable with respect to the body;

a conductive unit at an upper side of the heat dissipating mask; the conductive unit being electrically connected to the electric joint even when the heat dissipating mask rotates with respect to the body; and a lamp set driven electrically and installed at a lower side of the heat dissipating mask; the lamp set being retained to the conductive unit through the heat dissipating mask.

2. The lamp device as claimed in claim 1, wherein the connecting shaft passes through the axial hole and thus is connected to the heat dissipating mask: an interior of the body is installed with a motor and the connecting shaft extends from the motor and thus is driven by the motor.

3. The lamp device as claimed in claim 2, wherein an interior of the body is installed with a temperature sensor.

4. The lamp device as claimed in claim 1, wherein the heat dissipating mask has a plurality of heat dissipating fins which are radiatedly arranged.

5. The lamp device as claimed in claim 1, wherein the electric joint has two terminals which retain different distances to the connecting shaft; and the conductive unit are formed with two circular joints corresponding to the two terminals.

6. The lamp device as claimed in claim 1, wherein the lamp set includes a plurality of LEDs.

7. A lamp device comprising:

a seat electrically connected to an external power source; and a heat dissipation assembly connected to the seat and being rotatable with respect to the seat; one end of the heat dissipation assembly having light emitting elements electrically connected to the seat;

wherein the seat further including:

a body;

a head installed at an upper end of the body for electrically connecting an external power source;

an electric joint downwards extending from the head;

the heat dissipation assembly further including:

a heat dissipating mask being connected to the body; and the heat dissipating mask being rotatable with respect to the body;

a conductive unit installed in the heat dissipating mask; the conductive unit being electrically connected to the electric joint even when the heat dissipating mask rotates with respect to the body; and a lamp set driven electrically and installed in the heat dissipating mask; the lamp set being retained to the conductive unit through the heat dissipating mask.

8. The lamp device as claimed in claim 7, wherein a connecting shaft downwards extends from the body; and the heat dissipating mask has an axial hole; the connecting shaft passes through the axial hole to be combined to the heat dissipating mask; an interior of the body is installed with a motor and the connecting shaft extends from the motor and thus is driven by the motor.

9. The lamp device as claimed in claim 7, wherein an interior of the body is installed with a temperature sensor.

10. The lamp device as claimed in claim 7, wherein the heat dissipating mask has a plurality of heat dissipating fins which are radiatedly arranged.

11. The lamp device as claimed in claim 7, wherein the electric joint has two terminals which retain different distances to the connecting shaft; and the conductive unit are formed with two circular joints corresponding to the two terminals.

12. The lamp device as claimed in claim 7, wherein the lamp set includes a plurality of LEDs.

13. The lamp device as claimed in claim 7, wherein the seat further has a body; a lower end of the body is buckled to an upper end of the heat dissipating mask so that the heat dissipating mask is rotatable with respect to the body.

14. The lamp device as claimed in claim 13, wherein an area that the lower end of the body is buckled to an upper end of the heat dissipating mask is installed with a ball bearing or other kind of bearing.

* * * * *